US010435041B2

(12) United States Patent
Do et al.

(10) Patent No.: US 10,435,041 B2
(45) Date of Patent: Oct. 8, 2019

(54) COMPONENT COOLING DEVICE, IN PARTICULAR FOR A RAILROAD VEHICLE

(71) Applicant: ALSTOM TRANSPORT TECHNOLOGIES, Levallois Perret (FR)

(72) Inventors: Huu-Thi Do, Rochefort (FR); Tony Faucher, Ossun (FR)

(73) Assignee: Alstom Transport Technologies, Perret (FR)

( * ) Notice: Subject to any disclaimer, the term of this patent is extended or adjusted under 35 U.S.C. 154(b) by 463 days.

(21) Appl. No.: 14/559,718

(22) Filed: Dec. 3, 2014

(65) Prior Publication Data

US 2015/0158504 A1 Jun. 11, 2015

(30) Foreign Application Priority Data

Dec. 6, 2013 (FR) ..... 13 62269

(51) Int. Cl.
*B61D 27/00* (2006.01)
*B61C 17/04* (2006.01)

(52) U.S. Cl.
CPC ..... *B61D 27/009* (2013.01); *B61C 17/04* (2013.01)

(58) Field of Classification Search
CPC .... B61D 27/009; B61D 27/002; B61C 17/04; B60H 2001/3485; B60H 1/3232; B60H 1/00378; B60H 1/00407
USPC ..... 454/84, 137, 136, 242, 241; 224/325, 224/328, 324
See application file for complete search history.

(56) References Cited

U.S. PATENT DOCUMENTS

| | | | | |
|---|---|---|---|---|
| 2,218,561 | A * | 10/1940 | Strobell | B61D 27/009 454/108 |
| 5,605,055 | A * | 2/1997 | Salgado | B60H 1/00371 62/244 |
| 8,708,075 | B2 * | 4/2014 | Maurer | B60R 19/52 180/68.1 |
| 2004/0152411 | A1 * | 8/2004 | Gehring | B60H 1/3414 454/153 |
| 2007/0215398 | A1 | 9/2007 | Ferdows | |
| 2015/0158504 | A1 | 6/2015 | Do et al. | |

FOREIGN PATENT DOCUMENTS

| | | |
|---|---|---|
| DE | 29 37 005 | 4/1980 |
| EP | 0 963 895 A2 | 12/1999 |
| EP | 2 078 655 A1 | 7/2009 |
| FR | 2230514 A1 | 12/1974 |
| GB | 248270 | 3/1926 |
| GB | 800853 | 9/1958 |

(Continued)

*Primary Examiner* — Gregory L Huson
*Assistant Examiner* — Ryan L Faulkner
(74) *Attorney, Agent, or Firm* — Knobbe, Martens, Olson & Bear, LLP

(57) ABSTRACT

The cooling device (12) according to the disclosure includes a case (20), designed to be arranged on a roof (16) of the vehicle, said case (20) comprising two side walls (22) and one upper wall (24) together delimiting a housing for each component. Each housing forms an air guiding duct in which the corresponding component is housed, said duct extending between at least one side air inlet opening (32) arranged in one of the side walls (22) and one upper air outlet opening (34), arranged in the upper wall (24).

14 Claims, 2 Drawing Sheets

(56) References Cited

FOREIGN PATENT DOCUMENTS

| | | | |
|---|---|---|---|
| RU | 2009 100 677 | A | 7/2010 |
| RU | 113 704 | U1 | 2/2012 |
| SU | 302265 | | 4/1971 |

* cited by examiner

COMPONENT COOLING DEVICE, IN PARTICULAR FOR A RAILROAD VEHICLE

CROSS-REFERENCE TO RELATED APPLICATIONS

Any and all priority claims identified in the Application Data Sheet, or any correction thereto, are hereby incorporated by reference under 37 CFR 1.57. For example, this application claims priority to and the benefit of French Patent Application No. 2013-62269 filed in the French Patent Office on Dec. 6, 2013, the disclosure of which is incorporated in entirety by reference.

BACKGROUND

Field

The present disclosure relates to a device with at least one component, designed to equip a vehicle, in particular a railroad vehicle.

Description of the Related Technology

The disclosure for example relates to the cooling of electronic components, in particular brake resistances. Some railroad vehicle braking systems may in fact generate electricity during braking. These braking systems then include brake resistances, which are able to dissipate part of the electricity generated during braking.

Such brake resistances are typically cooled by a suitable device. In general, such a cooling device includes fans and/or at least one heat pump circuit.

SUMMARY

The present disclosure in particular aims to provide a system for cooling electronic components that is more economical than those existing in the state of the art, while allowing at least equally effective cooling.

To that end, the disclosure in particular relates to a system for cooling at least one component, designed to equip a vehicle, in particular a railroad vehicle, characterized in that:

- the device includes a case, designed to be arranged on a roof of the vehicle, said case comprising two side walls and one upper wall together delimiting a housing for each component,
- each housing forms an air guiding duct in which the corresponding component is housed, said duct extending between at least one side air inlet opening arranged in one of the side walls and one upper air outlet opening, arranged in the upper wall,
- each side opening has a symmetrical shape relative to the respective median plane perpendicular to the side wall and the upper wall, and
- each air guiding duct includes, for each side opening, an upstream part extending that side opening toward the corresponding component, that upstream part being delimited by substantially planar upper and lower surfaces, and by curved front and rear surfaces converging toward each other from the side opening toward the component.

When the vehicle moves, air rushes through each side inlet opening, and flows in the guide duct as far as the outlet opening. The component being arranged in that air guiding duct, the air streams flow in that duct in contact with that component, thus exchanging heat with that component to cool it.

Thus, the cooling system according to the disclosure does not require a fan or a heat pump, such that it has a lower production cost than the cooling systems of the state of the art, and no energy is specifically expended to cool the component, which allows additional savings.

A cooling device according to the invention may further include one or more of the following features, considered alone or according to all technically possible combinations:

- Each side air inlet opening is arranged across from the corresponding component.
- Each upper air outlet opening is arranged across from the corresponding component.
- For each component, the case has two side air inlet openings, each arranged on a respective side wall.
- Each upper air outlet opening has a symmetrical shape relative to a respective median plane perpendicular to the upper wall and the side walls.
- For each upper air outlet opening, the upper wall includes at least one deflector element, protruding up from the upper wall, and extending along a front or rear edge of the upper opening, perpendicular to the side walls.
- For each upper air outlet opening, the upper wall includes two deflector elements, respectively extending along the front edge and the rear edge of the upper opening.

The disclosure also relates to a railroad vehicle, including a roof, characterized in that it includes a cooling device as previously defined, arranged on said roof, for example in a housing arranged in said roof.

BRIEF DESCRIPTION OF THE DRAWINGS

The invention will be better understood upon reading the following description, provided solely as an example and done in reference to the appended figures, in which.

DETAILED DESCRIPTION OF CERTAIN EMBODIMENTS

Figure 1:
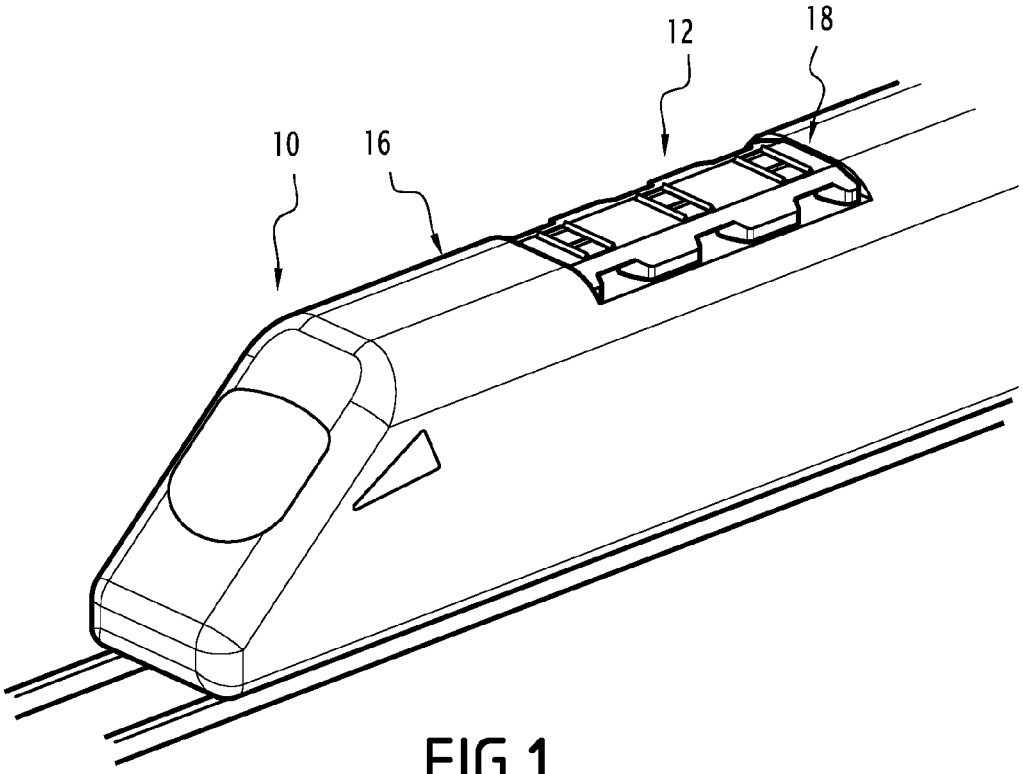
FIG. 1 is a perspective view of a railroad vehicle comprising a cooling device according to one example of the invention.

FIG. 1 shows a railroad vehicle 10 comprising a cooling device 12 according to one example embodiment.

In the present description, the terms "front" and "rear" are defined based on the direction of travel of the railroad vehicle. Such a railroad vehicle is typically able to move in two opposite directions, such that the front and rear of the vehicle may be reversed depending on the direction of travel.

The railroad vehicle 10 traditionally includes at least one component 14 to be cooled, for example at least one electronic component, in particular a resistance or a set of braking resistances. Said cooling device 12 is designed to cool each component 14.

Figure 3:
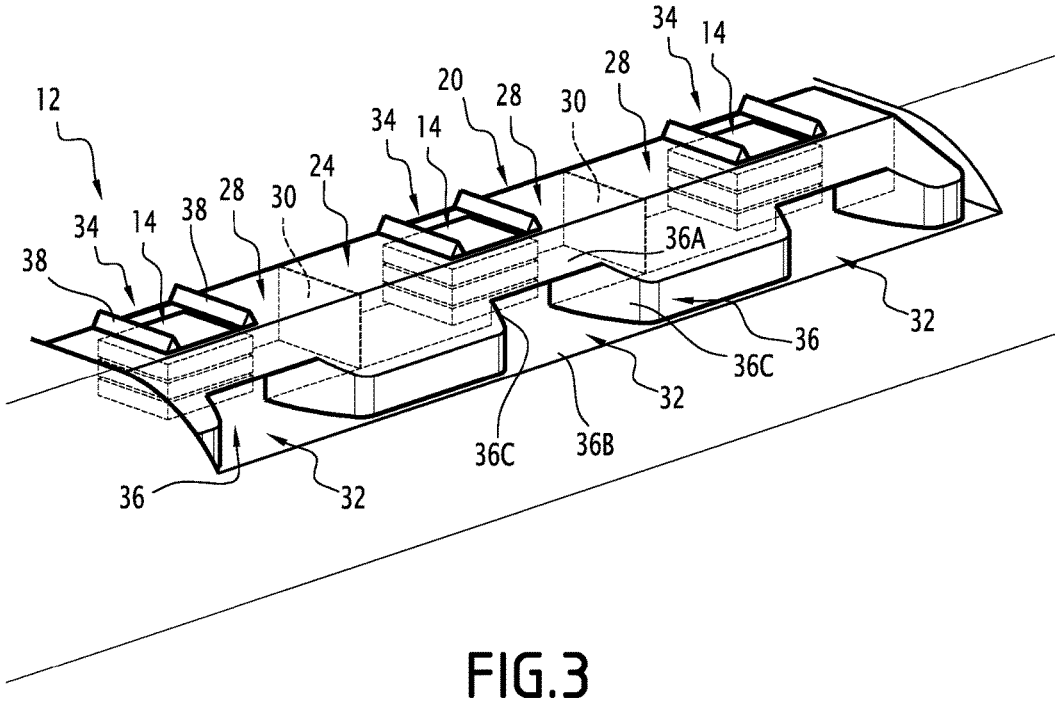
FIG. 3 is a perspective view of the cooling device of FIG. 2, partially shown, and some walls of which are shown transparently.

In the illustrated example, as shown in FIG. 3, the cooling device 12 is provided to cool three groups of components 14.

The railroad vehicle 10 includes at least one car provided with a roof 16, on which the cooling device 12 is arranged. For example, when the railroad vehicle 10 includes several cars, the cooling device 12 is arranged on the roof 16 of a motor coach of that railroad vehicle 10.

Advantageously, said roof 16 comprises a whole cooling device housing 18, in which the cooling device 12 is housed, such that said cooling device 12 does not extend, or extends little, protruding above that roof 16.

Figure 2:
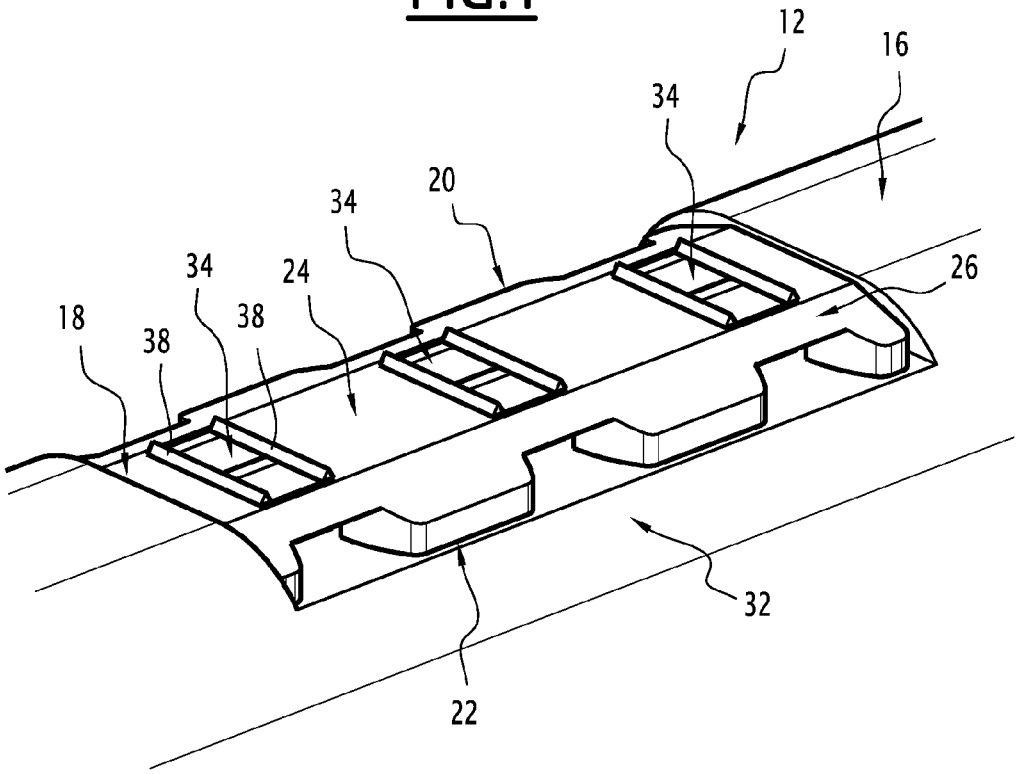
FIG. 2 is an enlarged view of the cooling device equipping the railroad vehicle of FIG. 1.

As shown in FIGS. 2 and 3, the cooling device 12 includes a case 20, comprising side walls 22 and an upper wall 24. In the illustrated example, the case 20 also comprises inclined intermediate walls 26, each extending transversely between a respective side wall 22 and the upper wall 24.

The case 20 is housed in said whole cooling device housing 18, such that the upper wall 24 is substantially flush with the roof 16 of the railroad vehicle.

The case 20 delimits a housing 28 for each component or group of components 14. For example, as in particular shown in FIG. 3, two adjacent housings 28 are separated by a tight wall 30 perpendicular to the upper wall 24 and the side walls 22.

Each housing 28 has at least one side air inlet opening 32 arranged in one of the side walls 22, and one upper air outlet opening 34 arranged in the upper wall 24.

Each housing 28 then forms an air guiding duct, in which the corresponding component or group of components 14 is housed, extending between each side inlet opening 32 and the upper air outlet opening 34.

Advantageously, each housing 28 has two side air inlet openings 32, each arranged in a respective side wall 22, therefore on either side of the component or group of components 14 housed in that housing 28.

Each air inlet opening 32 is arranged across from the corresponding component or group of components 14, and each air outlet opening 34 is arranged above the corresponding component or group of components 14, across from it. The air streams flowing in the housing 28 therefore pass directly from the air inlet openings 32 to the upper air outlet opening 34, passing through the component or group of components 14.

It should be noted that, in the case of a railroad vehicle, the cooling device 12 must be able to operate regardless of the direction of travel of the railroad vehicle.

To that end, each upper air outlet opening 34 has a symmetrical shape relative to a respective median plane perpendicular to the upper wall 24 and the side walls 22. Likewise, each side opening 32 has a symmetrical shape relative to a respective median plane perpendicular to the side wall 22 and the upper wall 24.

These symmetrical shapes make it possible to ensure a safe operating efficacy of the cooling device 12, irrespective of the direction of travel of the railroad vehicle 10.

For each side inlet opening 32, each air guiding duct in the housing 28 includes an upstream part 36 extending said side opening 32 toward the corresponding component 14. That upstream part 36 is delimited by upper 36A and lower 36B surfaces, which are substantially planar and parallel to each other, and by curved front and rear surfaces 36C converging toward each other from the side opening 32 toward the component 14. Thus, the upstream part 36 has a shape favoring speed acquisition by the air streams, which makes it possible to optimize cooling of the component 14.

Furthermore, for each upper air outlet opening 34, the upper wall 24 is provided with at least one deflector element 38 protruding up from an upper wall 24, and extending along a front or rear edge of the upper air outlet opening 34, perpendicular to the side walls 22. Each deflector element 38 for example has a triangular section.

More particularly, in order for the cooling device 12 to have a same optimal operation irrespective of the direction of travel of the railroad vehicle, each upper air outlet opening 34 is provided with two deflector elements 38, one extending along the front edge and the other along the rear edge of the upper air outlet opening 34.

The deflector element 38 extending along the front edge makes it possible to deflect the air traveling along the roof 16 of the railroad vehicle 10, such that said air bypasses the upper air outlet opening 34 and does not penetrate the housing 28 through that upper air outlet opening 34. This deflector element 38 also makes it possible to generate a vacuum above the upper air outlet opening 34, favoring the flow of the air streams in the guiding duct 18, from the side inlet openings 32 to the upper outlet opening 34.

It will be noted that the disclosure is not limited to the embodiment previously described, but could assume various alternatives without going beyond the scope of the claims.

In particular, the cooling device 12 could be designed to cool other components.

Furthermore, the cooling device 12 could equip another type of vehicle, for example a road or air vehicle. In that case, it is not necessary to provide symmetrical operation of the cooling device.

What is claimed is:

1. A cooling device for cooling a component, designed to equip a vehicle, comprising:

a case, designed to be arranged on a roof of the vehicle, said case comprising two side walls and one upper wall together delimiting a housing for the component, the housing forming an air guiding duct in which the component is housed, said air guiding duct extending between a side air inlet opening arranged in one of the side walls and an upper air outlet opening, arranged in the upper wall, the side air inlet opening having a symmetrical shape relative to a respective median plane perpendicular to the side wall and the upper wall, and the upper air outlet opening having a symmetrical shape relative to a median plane perpendicular to the upper wall and the side walls, wherein the upper wall comprises a front deflector protruding up from the upper wall along a front edge of the upper opening perpendicular to the side walls and a rear deflector protruding up from the upper wall along a rear edge of the upper opening perpendicular to the sidewalls, such that the cooling device can operate in both a front direction of travel and a rear direction of travel, the air guiding duct comprising an upstream part extending the side air inlet opening toward the component, the upstream part being delimited by substantially planar upper and lower surfaces, and by curved front and rear surfaces converging toward each other from the side air inlet opening toward the component, such that an air stream flowing into the housing passes through the component as it passes from the air inlet opening to the air outlet opening, and wherein the cooling device is devoid of any fan.

2. The cooling device according to claim 1, wherein each side air inlet opening is arranged across from the corresponding component.

3. The cooling device according to claim 1, wherein each upper air outlet opening is arranged across from the corresponding component.

4. The cooling device according to claim 1, wherein for each component, the case has two side air inlet openings, each arranged on a respective side wall.

5. The cooling device according to claim 1, wherein each upper air outlet opening has a symmetrical shape relative to a respective median plane perpendicular to the upper wall and the side walls.

6. The cooling device according to claim 1, wherein for each upper air outlet opening, the upper wall includes at least one deflector element, protruding up from the upper wall, and extending along a front or rear edge of the upper air outlet opening, perpendicular to the side walls.

7. The cooling device according to claim 6, wherein for each upper air outlet opening, the upper wall includes two deflector elements, respectively extending along the front edge and the rear edge of the upper air outlet opening.

8. A railroad vehicle, comprising a roof, comprising a cooling device with at least one component arranged on said roof, wherein:

the cooling device comprises a case, arranged on said roof, said case comprising two side walls and one upper wall together delimiting a housing for each component, each housing forms an air guiding duct in which the corresponding component is housed, said air guiding duct extending between at least one side air inlet opening arranged in one of the side walls and one upper air outlet opening, arranged in the upper wall, each side air inlet opening has a symmetrical shape relative to the respective median plane perpendicular to the side wall and the upper wall, and each upper air outlet opening having a symmetrical shape relative to a median plane perpendicular to the upper wall and the side walls, wherein the upper wall comprises a front deflector protruding up from the upper wall along a front edge of the upper opening perpendicular to the side walls and a rear deflector protruding up from the upper wall along a rear edge of the upper opening perpendicular to the sidewalls, such that the cooling device can operate in both a front direction of travel and a rear direction of travel, each air guiding duct includes, for each side air inlet opening, an upstream part extending that side air inlet opening toward the corresponding component, that upstream part being delimited by substantially planar upper and lower surfaces, and by curved front and rear surfaces converging toward each other from the side air inlet opening toward the component, such that an air stream flowing into the housing passes through the component as it passes from the air inlet opening to the air outlet opening, and wherein the cooling device is devoid of any fan.

9. The railroad vehicle according to claim 8, wherein each side air inlet opening is arranged across from the corresponding component.

10. The railroad vehicle according to claim 8, wherein each upper air outlet opening is arranged across from the corresponding component.

11. The railroad vehicle according to claim 8, wherein for each component, the case has two side air inlet openings, each arranged on a respective side wall.

12. The railroad vehicle according to claim 8, wherein each upper air outlet opening has a symmetrical shape relative to a respective median plane perpendicular to the upper wall and the side walls.

13. The railroad vehicle according to claim 8, wherein for each upper air outlet opening, the upper wall includes at least one deflector element, protruding up from the upper wall, and extending along a front or rear edge of the upper air outlet opening, perpendicular to the side walls.

14. The railroad vehicle according to claim 13, wherein for each upper air outlet opening, the upper wall includes two deflector elements, respectively extending along the front edge and the rear edge of the upper air outlet opening.

* * * * *